US011849815B2

(12) United States Patent
Chui et al.

(10) Patent No.: US 11,849,815 B2
(45) Date of Patent: Dec. 26, 2023

(54) FASTENER, FASTENER MONITORING SYSTEM, AND CHILD CARRIER

(71) Applicant: WONDERLAND SWITZERLAND AG, Steinhausen (CH)

(72) Inventors: Zongwang Chui, Steinhausen (CH); Manqun Cheng, Steinhausen (CH)

(73) Assignee: WONDERLAND SWITZERLAND AG, Steinhausen (CH)

( * ) Notice: Subject to any disclaimer, the term of this patent is extended or adjusted under 35 U.S.C. 154(b) by 8 days.

(21) Appl. No.: 17/697,591

(22) Filed: Mar. 17, 2022

(65) Prior Publication Data

US 2022/0295948 A1 Sep. 22, 2022

(30) Foreign Application Priority Data

Mar. 18, 2021 (CN) ..... 202110292855.6

(51) Int. Cl.
*A44B 11/25* (2006.01)

(52) U.S. Cl.
CPC ..... *A44B 11/2592* (2013.01)

(58) Field of Classification Search
CPC ..... A44B 11/2592
See application file for complete search history.

(56) References Cited

U.S. PATENT DOCUMENTS 4,372,580 A * 2/1983 Motonami ..... B60R 22/04 280/808
5,979,026 A 11/1999 Anthony
6,851,503 B2 * 2/2005 Almaraz ..... B60R 21/0155 24/641
7,002,457 B2 * 2/2006 Stevenson ..... B60R 22/48 280/801.1
7,116,220 B2 * 10/2006 Almaraz ..... B60R 22/48 24/69 SB
7,340,809 B2 * 3/2008 Tracy ..... B60N 2/2812 24/615
8,196,377 B1 * 6/2012 Putty ..... B68C 1/00 54/69
11,396,272 B2 * 7/2022 Li ..... B60R 22/48
(Continued)

FOREIGN PATENT DOCUMENTS

CN 203666586 U 6/2014
CN 207731453 U 8/2018
TW 201639489 A 11/2016

OTHER PUBLICATIONS

Taiwan Office Action issued in corresponding Taiwan Application No. 111109779, dated Jul. 10, 2023, pp. 1-28.

*Primary Examiner* — Jason W San
(74) *Attorney, Agent, or Firm* — HAUPTMAN HAM, LLP

(57) ABSTRACT

This application relates to a fastener, a fastener monitoring system, and a child carrier. The fastener includes a male buckle, a female buckle, and a control circuit. The fastener has a locked state in which the male buckle is snap-fitted to the female buckle and an unlocked state in which the male buckle is separated from the female buckle. The control circuit is disposed on the male buckle and/or the female buckle. The control circuit includes a wireless communication module. In response to the fastener being in the locked state, the control circuit controls the wireless communication module to transmit a wireless signal.

18 Claims, 8 Drawing Sheets

(56) References Cited

U.S. PATENT DOCUMENTS 11,639,787 B2 * 5/2023 Lee ..... H01R 13/6205 439/537
2004/0119599 A1 6/2004 Stevenson et al.
2006/0080812 A1 * 4/2006 O'Brien ..... A44B 11/25 24/633
2012/0104826 A1 * 5/2012 Miller ..... B60N 2/2812 24/593.1
2012/0144630 A1 * 6/2012 Nimura ..... A44B 11/2523 24/593.1
2012/0310483 A1 * 12/2012 Lanter ..... B60R 22/48 24/593.1
2013/0207442 A1 * 8/2013 Sickon ..... G01B 7/14 24/593.1
2013/0261800 A1 * 10/2013 Makley ..... A44B 11/005 700/275
2014/0109360 A1 * 4/2014 Kelleghan ..... A44B 11/2565 24/633
2016/0018978 A1 * 1/2016 Zenoff ..... G06F 1/1698 715/731
2016/0081440 A1 * 3/2016 Baek ..... G06F 1/163 24/71 J
2017/0105096 A1 * 4/2017 Olson ..... H04B 17/318
2018/0200140 A1 * 7/2018 Ganske ..... G16H 40/40
2019/0133260 A1 * 5/2019 Boughner ..... A44B 11/2523
2019/0174875 A1 * 6/2019 Cheng ..... B62B 9/24
2020/0383432 A1 * 12/2020 Cheng ..... A44B 11/2503
2022/0295946 A1 * 9/2022 Cheng ..... A44B 11/2519
2022/0295948 A1 * 9/2022 Chui ..... A44B 11/2569
2022/0363219 A1 * 11/2022 Guo ..... B60R 22/48
2023/0062990 A1 * 3/2023 Wang ..... B62B 9/14
2023/0119709 A1 * 4/2023 Wang ..... B60N 2/2824 297/256.13
2023/0128918 A1 * 4/2023 Chui ..... B60N 2/2884 297/216.11

* cited by examiner

FASTENER, FASTENER MONITORING SYSTEM, AND CHILD CARRIER

CROSS-REFERENCE TO RELATED APPLICATIONS

This application claims priority to the Chinese Patent Application No. 2021102928556, filed with the China National Intellectual Property Administration on Mar. 18, 2021, and entitled "FASTENER, FASTENER MONITORING SYSTEM, AND CHILD CARRIER", the entire content of which is incorporated herein in its entirety.

TECHNICAL FIELD

The present disclosure relates to the field of fasteners, and in particular, to a fastener, a fastener monitoring system, and a child carrier.

BACKGROUND

Various child carriers (such as baby carriages, baby cradles, safety seats, and hipseat carriers) are widely used in families with children. The child carriers cannot be used without fasteners. By means of mating between a fastener and a strap, the children can be safely protected in the child carriers.

During use of the child carriers, children may be left in the child carriers for a long time due to the negligence of caregivers. When the child carrier is used in a vehicle, the children left in the child carriers may be at risk.

SUMMARY

According to some embodiments, a fastener is provided to allow a user to remotely monitor a buckling state of the fastener. A fastener monitoring system and a child carrier are also provided.

The fastener includes a male buckle, a female buckle, and a control circuit. The fastener has a locked state in which the male buckle is snap-fitted to the female buckle and an unlocked state in which the male buckle is separated from the female buckle. The control circuit is disposed on the male buckle and/or the female buckle. The control circuit includes a wireless communication module. When the fastener is in the locked state, the wireless communication module transmits a wireless signal.

The fastener monitoring system includes a terminal device and the aforementioned fastener. The terminal device is configured to receive the wireless signal transmitted by the wireless communication module.

The child carrier including the aforementioned fastener is provided.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Figure 1:
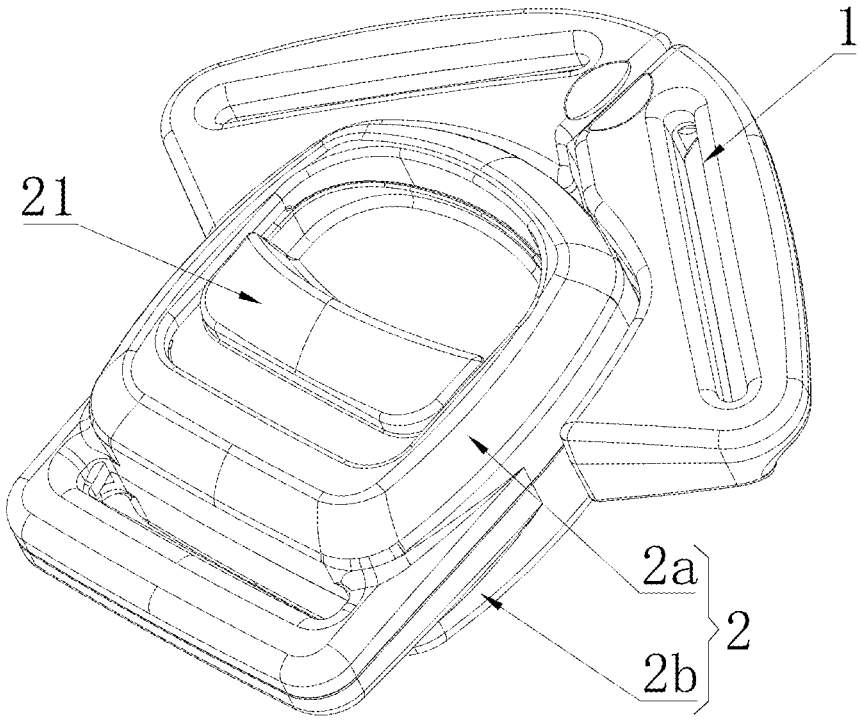
FIG. 1 is a perspective view of a fastener according to a first embodiment.
Figure 2:
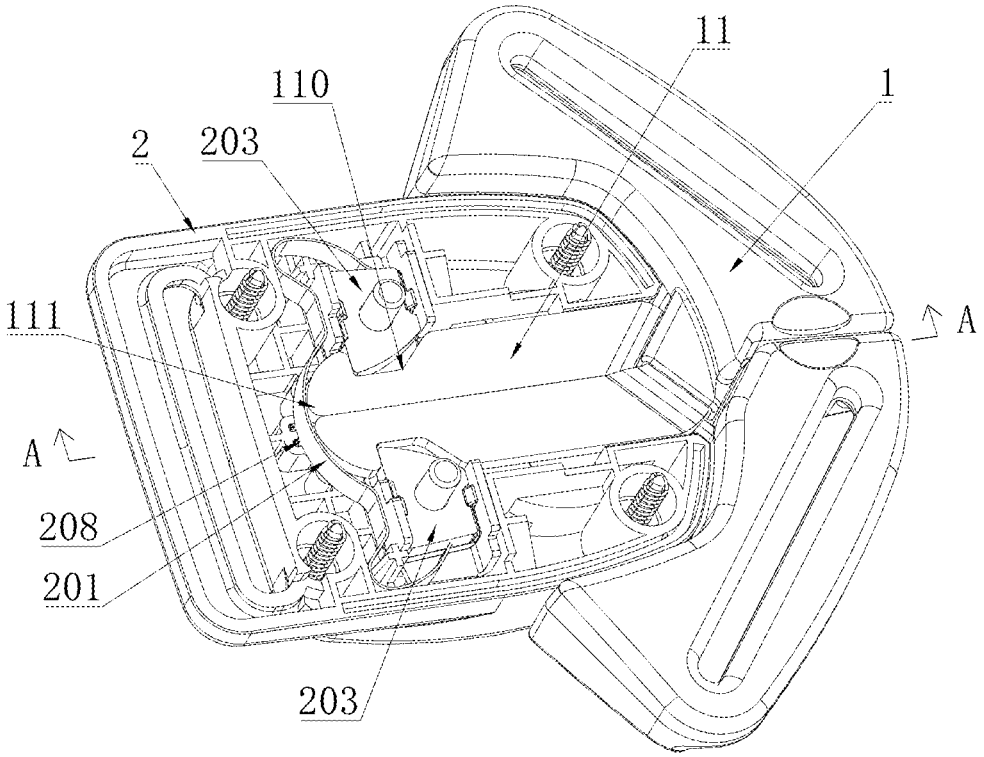
FIG. 2 is a perspective view of the fastener shown in FIG. 1 after a first housing is removed.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

First Embodiment

Figure 3:
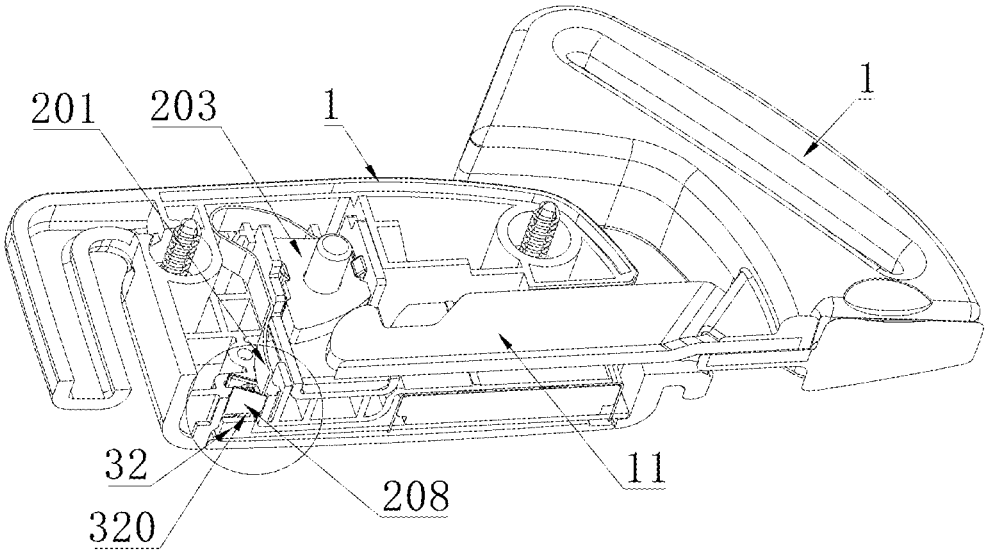
FIG. 3 is a cross-sectional view taken along line A-A in FIG. 2.
Figure 4:
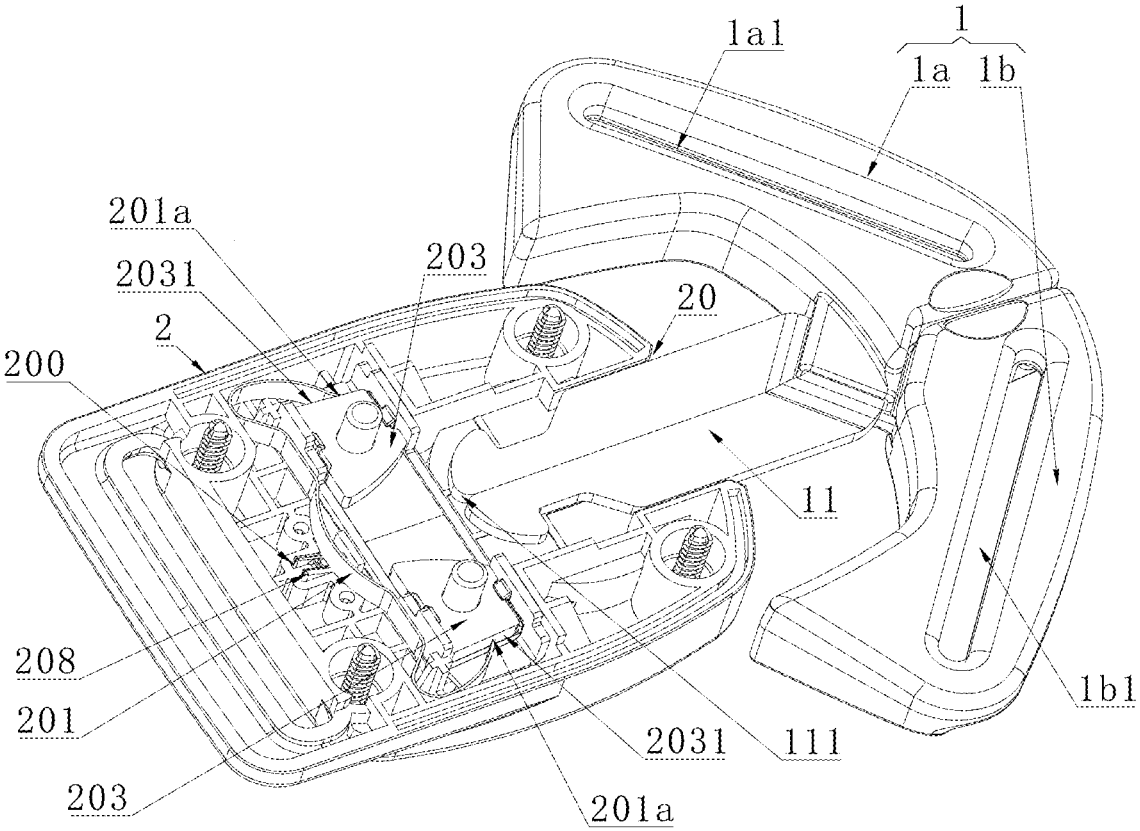
FIG. 4 is a perspective view of the fastener in FIG. 2 in another state.

FIG. 1 to FIG. 6 schematically show a fastener according to a first embodiment of the present disclosure. The fastener includes a male buckle 1 and a female buckle 2. The male buckle 1 has an inserting portion 11 (FIG. 2), and the female buckle 2 has a slot 20 (FIG. 4). The inserting portion 11 of the male buckle 1 may be inserted into the female buckle 2 through the slot 20, so as to be snap-fitted to the female buckle 2. The female buckle 2 may have an unlocking button 21. The male buckle 1 and the female buckle 2 may be unlocked by pressing the unlocking button 21. Therefore, the fastener has a locked state (FIG. 2) and an unlocked state (FIGS. 3 & 4).

Figure 7:
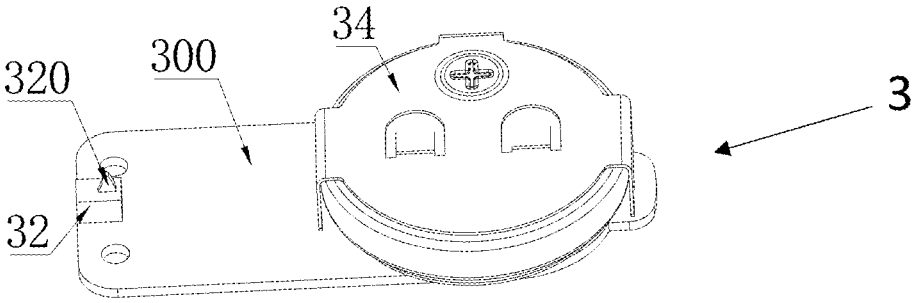
FIG. 7 is a perspective view of a circuit board.
Figure 8:
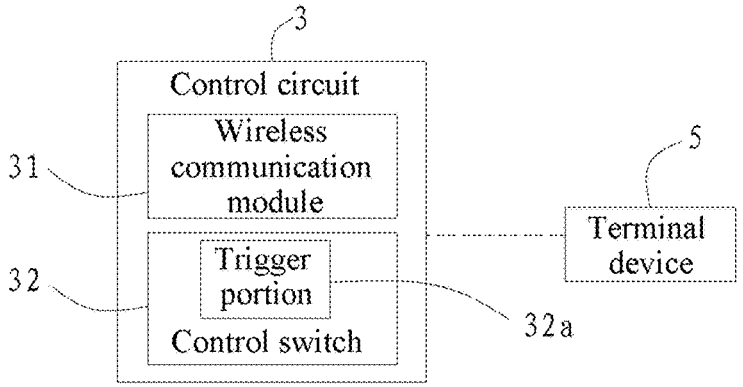
FIG. 8 is a block diagram of a fastener monitoring system according to an embodiment.

Referring to FIG. 7, the fastener further includes a control circuit 3. The control circuit 3 is disposed on the male buckle 1 and/or the female buckle 2. The control circuit 3 includes a processor (not shown) and a wireless communication module 31 (FIG. 8). When the male buckle 1 and the female buckle 2 are in the locked state, the processor controls the wireless communication module 31 to transmit a wireless signal. The wireless signal is transmitted through a wireless transmission network and then received by a terminal device 5. The wireless signal includes, for example, locking information of the fastener and/or position information of the fastener. The terminal device 5 may be a mobile terminal such as a mobile phone, a smart watch, or a smart bracelet. In some embodiments, the wireless signal is, for example, a Bluetooth signal or a Wi-Fi signal. The wireless transmission network may be local area network such as a Bluetooth transmission network, a Wi-Fi network, or a WAPI network. In other embodiments, the network may be a mobile communication network, such as 2G, 3G, 4G, or 5G.

When the fastener in this embodiment is in the locked state, the wireless communication module 31 transmits the wireless signal to the terminal device 5. When a distance of the terminal device 5 away from the fastener is no less than a preset distance (for example, 5 meters), the terminal device 5 sends out a warning signal. Alternatively, when a signal intensity of the wireless signal (for example, the Bluetooth signal or the Wi-Fi signal) received by the terminal device 5 decreases until the signal intensity is not greater than a threshold, the terminal device 5 sends out a warning signal. The warning signal may be, for example, a vibration warning, a sound warning, a text warning, a flashing screen warning, or a pattern warning, which can be used to notify the user carrying the terminal device 5 that the fastener is still in the locked state. The fastener is especially suitable for a child safety seat. When a driver of a vehicle leaves and locks the vehicle without unlocking the fastener of the child safety seat, after the driver leaves the vehicle for a specified distance, the terminal device 5 carried by the driver sends out the above warning signal to remind the driver that the fastener of the child safety seat is still locked and that the child may be left in the vehicle. After receiving the warning signal, the driver can return to the vehicle in time to take the child out of the vehicle, thereby preventing the child from danger. In other embodiments, the fastener is applicable to other products (such as a baby carriage), to prevent a child from being left in areas such as a public place or a residence as a result of being forgotten by a caregiver or prevent a child from a danger such as being taken away by a stranger.

It should be understood that, when the fastener is in the locked state, the wireless communication module 31 transmits the wireless signal. As such, the user carrying the terminal device 5 may determine whether the fastener is in the locked state depending on whether the terminal device 5 receives the wireless signal.

In some other embodiments, the wireless signal transmitted by the wireless communication module 31 may include, for example, position information of the fastener. As such, when the terminal device 5 receives the wireless signal, an approximate distance between the terminal device 5 and the fastener may be determined by comparing the position information of the terminal device with the position information of the fastener. When the distance between the terminal device 5 and the fastener is no less than a preset distance, the terminal device 5 may send out the above warning signal.

Figure 6:
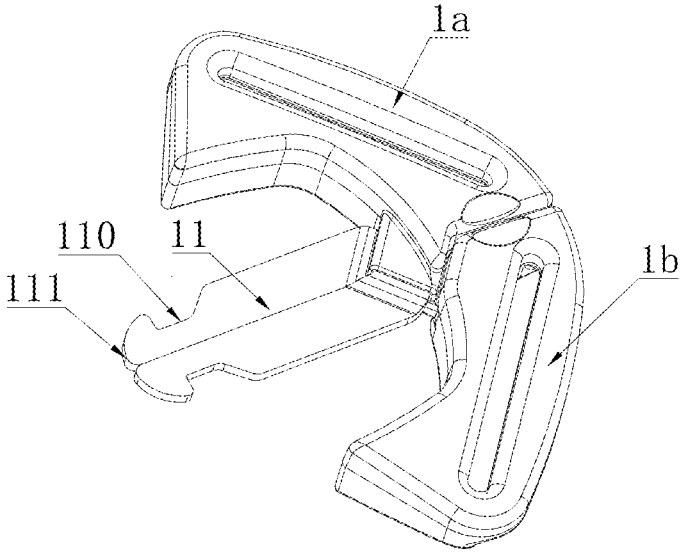
FIG. 6 is a perspective view of a male buckle shown in FIG. 4.

Referring to FIG. 4 and FIG. 6, the fastener in this embodiment is, for example, a fastener of a child safety seat. The male buckle 1 may include a half male buckle portion 1*a* and a half male buckle portion 1*b*. The two half male buckle portions 1*a* and 1*b* respectively include safety belt passing holes 1*a*1 and 1*b*1. Two safety belts (not shown) passing through the safety belt through holes 1*a*1 and 1*b*1 are configured to bind shoulders of the child. Each safety belt is pulled to cause the two half male buckle portions 1*a* and 1*b* to approach each other. The two half male buckle portions 1*a* and 1*b* can be combined to form a complete male buckle 1, which can be snap-fitted to the female buckle 2, so as to secure the children in the child safety seat. Referring to FIG. 1, in some embodiments, the female buckle 2 may include a first housing 2*a* and a second housing 2*b*. The first housing 2*a* and the second housing 2*b* are combined together to define the slot 20 of the female buckle 2. The unlocking button 21 is, for example, mounted to the first housing 2*a*. It should be understood that the fastener 1 may be any fastener including the male buckle 1 and the female buckle 2, which can be used and not limited to the child carrier exemplified above.

Figure 9:
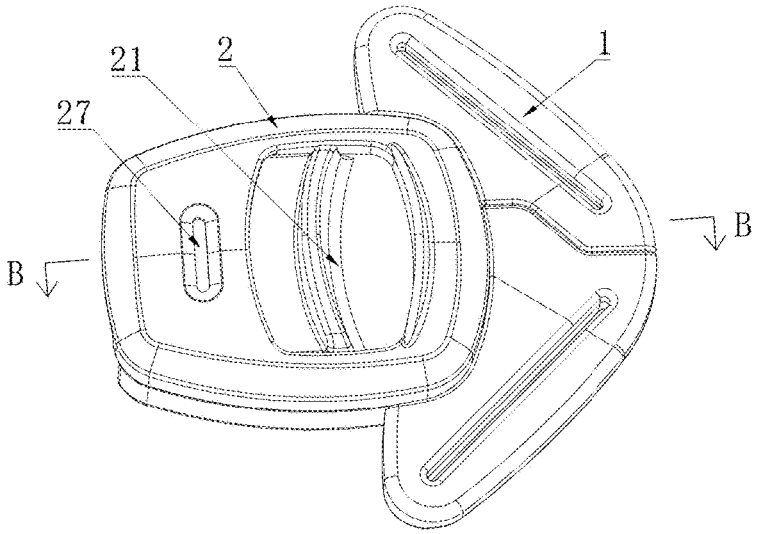
FIG. 9 is a perspective view of a fastener according to a second embodiment.
Figure 10:
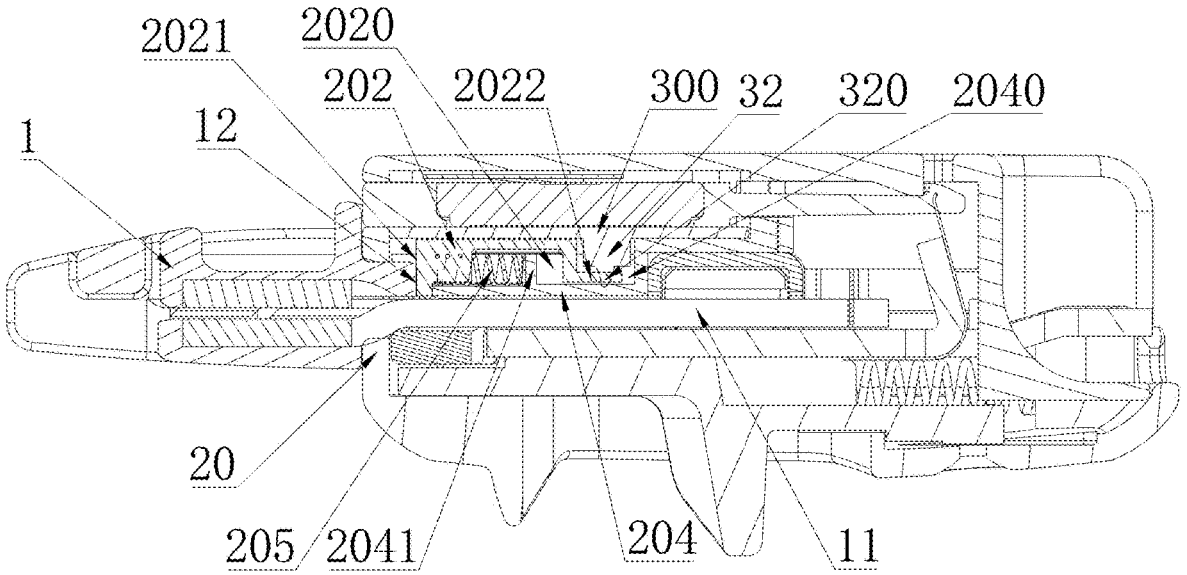
FIG. 10 is a cross-sectional view taken along B-B in FIG. 9.
Figure 11:
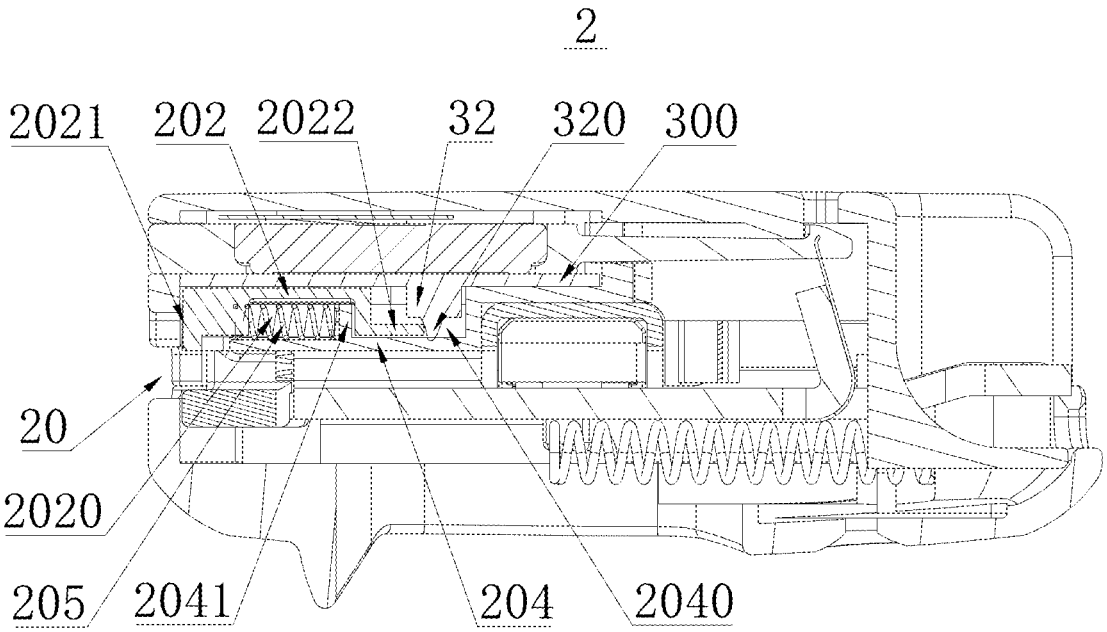
FIG. 11 is a cross-sectional view of FIG. 9 in another state, where a male buckle is completely pulled out of the female buckle.

In some embodiments, when the male buckle 1 and the female buckle 2 are in the locked state, the processor of the control circuit 3 may control the wireless communication module 31 to transmit the wireless signal. As described above, the wireless signal may be, for example, transmitted to the terminal device 5. Generally, the user may determine whether the male buckle 1 is inserted into the female buckle 2 in place depending on whether a "click" sound occurs during inserting of the male buckle 1 into the female buckle 2. Alternatively, a display window 27 (see FIG. 9) is provided on the female buckle 2. When the male buckle 1 is inserted into the female buckle 2, the user determines whether the male buckle 1 is inserted in place according to a color displayed on the display window 27. Generally, after the male buckle 1 is inserted in place, the display window 27 displays a green color. According to the fastener provided in this embodiment, the user may alternatively determine whether the male buckle 1 is inserted in place by using the wireless signal received by the terminal device 5. Therefore, double confirmation of whether the male buckle 1 and the female buckle 2 are in the locked state is realized.

Referring to FIG. 7, in some embodiments, the control circuit 3 may be integrated on a circuit board 300. The circuit board 300 is, for example, a PCB (printed circuit board). In addition, a power supply 34 configured to supply power to the control circuit 3 may be mounted to the circuit board 300. The power supply 34, is for example, a button cell. In the illustrated embodiment, the circuit board 300 is mounted inside the female buckle 2. In other embodiments, the circuit board 300 may be mounted to the male buckle 1. In addition, in some other embodiments, the control circuit 3 may not be composed of circuits integrated on one circuit board. Instead, for example, the control circuit 3 may be composed of circuits distributed in the male buckle 1 and the female buckle 2, as long as the wireless communication module 31 can transmit the wireless signal after the fastener is switched to the locked state.

Referring to FIG. 2 to FIG. 8, in some embodiments, the control circuit 3 may further include a control switch 32. The control switch 32 may be switched between turn-on and turn-off when the fastener is switched between the locked state and the unlocked state. When the control switch 32 is turned on, the processor of the control circuit 3 controls the wireless communication module 31 to transmit the wireless signal.

The control switch 32 may be, for example, a mechanical physical contact switch, or may be an inductive switch (for example, a proximity switch). The control switch 32 has, for example, a trigger portion 32*a* (FIG. 8). The trigger portion 32*a* and the circuit board 300 are located in the female buckle 2. According to different types of the control switch 32, the trigger portion 32*a* may be an elastic trigger button 320 or a sensing module. The following example will be described in which the control switch is the mechanical contact switch and the trigger portion 32*a* is the elastic trigger button 320. When the fastener is switched between the locked state and the unlocked state, the elastic trigger button 320 of the control switch 32 is pressed or automatically pops up correspondingly with the insertion and the pull-out of the male buckle 1. If the fastener is in the locked state, the elastic trigger button 320 is pressed, so that the control switch 32 is turned on. If the fastener is in the unlocked state, the elastic trigger button 320 automatically pops up, so that the control switch 32 is turned off.

Referring to FIG. 7, in this embodiment, the elastic trigger button 320 may have an arcuate contact surface adapted to be pressed. When the arcuate contact surface is pressed, the elastic trigger button 320 is, for example, pivotally pressed to turn on the control switch 32. When the pressing force on the arcuate contact surface is released, the elastic trigger button 320 can automatically rotate to turn off the control switch 32. It should be understood that a structure of the elastic trigger button 320 is not limited to the description in this embodiment. For example, in other embodiments, the elastic trigger button 320 may have a plane or a slope adapted to be pressed.

It may be understood that, in other embodiments, when the trigger portion 32*a* is the sensing module, the processor of the control circuit 3 may control the wireless communication module 31 to transmit or not to transmit the above wireless signal depending on whether the sensing module senses an object by means of, for example, pressure sensing, light sensing, or magnetic sensing.

In some embodiments, the triggering of the trigger portion 32*a* may be, for example, associated with movement of a driving member disposed in the female buckle 2. The driving member is independent of the control switch 32, and the movement of the driving member is associated with the insertion and the pull-out of the male buckle 1. When the inserting portion 11 of the male buckle 1 is inserted into the slot 20 of the female buckle 2 to cause the fastener to switch from the unlocked state to the locked state, the driving member can be pushed by the male buckle 1 to move. Since the trigger portion 32*a* is on a moving path of the driving member, the trigger portion can be triggered, so that the control switch 32 can be turned on. When the inserting portion 11 of the male buckle 1 is pulled out of the slot 20 of the female buckle 2 to cause the fastener to switch from the locked state to the unlocked state, the driving member can be automatically reset and be separated from the trigger portion 32*a*, so that the control switch 32 is turned off. In this embodiment, the trigger portion 32*a* of the control switch 32 is triggered by the driving member. As such, the control switch 32 can adapt to an internal structure requirement of the female buckle 2 to be disposed at a proper position in the female buckle 2.

The driving member has many implementations. For example, in this embodiment, the driving member is a return elastic piece 201 located in the female buckle 2. Both ends 201*a* of the return elastic piece 201 respectively abut against outer sides of two sliding locking blocks 203 in the female buckle 2 facing away from each other. The inserting portion 11 of the male buckle 1 can pass through the two sliding locking blocks 203 and can be locked by the two sliding locking blocks 203. Specifically, during the insertion of the inserting portion 11 of the male buckle 1 into the female buckle 2, the inserting portion 11 first pushes the two sliding locking blocks 203 to overcome an elastic force of the return elastic piece 201 to be separated from each other. When two latching grooves 110 of the inserting portion 11 respectively correspond to the sliding locking blocks 203, both ends 201*a* of the return elastic piece 201 push the two sliding locking blocks 203 to move in opposite directions and be latched in the two latching grooves 110, respectively. The return elastic piece 201 maintains the two sliding locking blocks 203 at a position where the male buckle 1 is locked.

During the switching of the male buckle 1 and the female buckle 2 from the unlocked state to the locked state, a middle portion of the return elastic piece 201 is pressed by an end portion 111 of the inserting portion 11 of the male buckle 1 and is elastically deformed, so that the middle portion of the return elastic piece 201 protrudes in a direction away from the male buckle 1. When the unlocking button 21 is not subjected to a pressing force for unlocking the male buckle 1, the position of the unlocking button on the female buckle 2 is maintained by a button spring (not shown). When subjected to the pressing force for unlocking the male buckle 1, the unlocking button 21 overcomes a force of the button spring to move and drive the two sliding locking blocks 203 to move away from each other. As such, the inserting portion 11 of the male buckle 1 can withdraw from the position between the two sliding locking blocks 203. For a specific structure in which the unlocking button 21 drives the two sliding locking blocks 203 to move away from each other so as to unlock the male buckle 1 and the female buckle 2 can be found in the related art, and details are not described herein again.

In some embodiments, the trigger portion 32*a* (for example, the elastic trigger button 320 or the sensing module) of the control switch 32 may be arranged on a moving path of the middle portion of the return elastic piece 201. Taking the elastic trigger button 320 as an example hereafter, when the male buckle 1 is inserted in place, the middle portion of the return elastic piece 201 can move and press the arcuate contact surface of the elastic trigger button 320 directly. Therefore, the elastic trigger button 320 is pressed, and the control switch 32 is in the turned-on state. As described above, in this case, the processor of the control circuit 3 may control the wireless communication module 31 to transmit the wireless signal. When the male buckle 1 and the female buckle 2 are unlocked, the return elastic piece 201 is no longer pressed by the inserting portion 11 of the male buckle 1 and is automatically reset. The return elastic piece 201 after reset will no longer press the elastic trigger button 320, so that the elastic trigger button 320 automatically pops up and is reset. Therefore, the control switch 32 can be automatically returned to the turned-off state.

Figure 5:
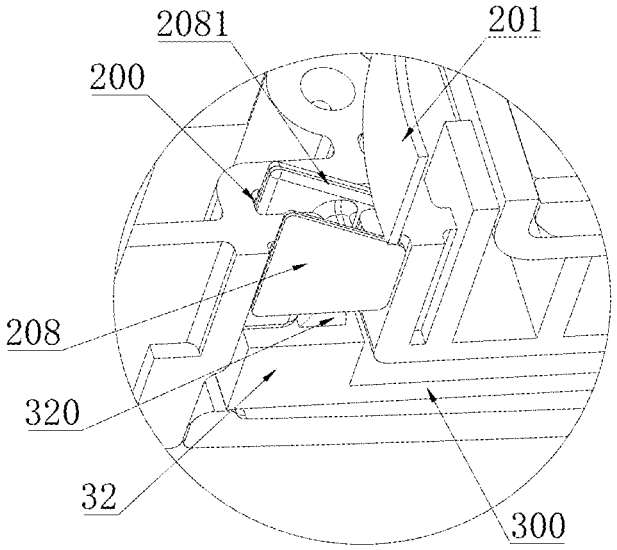
FIG. 5 is a partial enlarged view of FIG. 3.

In this embodiment, the return elastic piece 201 actuates the elastic trigger button 320 indirectly by using a trigger member 208. Referring to FIG. 4 and FIG. 5, a through hole 200 may be provided at a position inside the female buckle 2 corresponding to the elastic trigger button 320. An axial direction of the through hole 200 may be substantially perpendicular to an insertion direction of the male buckle 1. The trigger member 208 capable of moving along the through hole 200 is disposed in the through hole 200. The trigger member 208 is located on the moving path of the middle portion of the return elastic piece 201. The return elastic piece 201 triggers the elastic trigger button 320 by using the trigger member 208. For example, the trigger member 208 may be a U-shaped plate. A closed end (a first end) of the U-shaped plate abuts against the elastic trigger button 320. An open end (a second end) of the U-shaped plate is provided with a slope 2081. The slope 2081 is configured to abut against the return elastic piece 201. When the middle portion of the return elastic piece 201 moves due to the insertion of the male buckle 1, the slope 2081 causes the trigger member 208 to be pressed toward the elastic trigger button 320 by the middle portion of the return elastic piece 201, so as to turn on the control switch 32. When the male buckle 1 is pulled out of the female buckle 2, the return elastic piece 201 is automatically reset and on longer presses the trigger member 208. When the elastic trigger button 320 is automatically reset, the trigger member 208 is pushed to reset, and the control switch 32 is turned off. It should be understood that, in other embodiments, the slope 2081 may not be provided on the second end of the trigger member 208. Instead, a slope configured to push the trigger member 208 to move is provided on the return elastic piece 201.

Second Embodiment

FIG. 9 to FIG. 15 schematically show a fastener according to a second embodiment of the present disclosure.

Similar to the first embodiment described above, in the second embodiment, the fastener includes a male buckle 1 and a female buckle 2. The male buckle 1 has an inserting portion 11, and the female buckle 2 has a slot 20. The inserting portion 11 of the male buckle 1 may be inserted into the slot 20 to be snap-fitted to the female buckle 2. The female buckle 2 has an unlocking button 21. The male buckle 1 and the female buckle 2 may be unlocked by pressing the unlocking button 21. Therefore, the fastener has the locked state and the unlocked state. The control circuit 3 (referring to FIG. 8) includes a control switch 32 and a wireless communication module 31. The control switch 32 has a trigger portion 32*a* located in the female buckle 2. A driving member is provided in the female buckle 2. The driving member can be pushed by the male buckle 1 when the male buckle 1 is inserted into the female buckle 2 and can be automatically reset when the male buckle 1 is pulled out of the female buckle 2. The movement of the driving member can cause the driving member to trigger the trigger portion 32*a* of the control switch 32 to turn on the control switch 32 or can cause the driving member to be separated from the trigger portion 32*a* of the control switch 32 to turn off of the control switch 32. A processor of the control circuit 3 (FIG. 15) controls the wireless communication module 31 to transmit the above wireless signal when the control switch 32 is turned on. The wireless signal is, for example, transmitted through a wireless transmission network and then received by a terminal device 5.

The difference between the second embodiment and the first embodiment mainly lies in that the driving member is formed by a sliding block 202 additionally provided in the female buckle 2. The sliding block 202 is slidably mated with a support structure 204 inside the female buckle 2. The sliding block 202 has a pressed portion 2021 and an actuating portion 2022. When the male buckle 1 and the female buckle 2 are in the unlocked state, the sliding block 202 is at a first position (see FIG. 11) in the female buckle 2. When the inserting portion 11 of the male buckle 1 is inserted into the slot 20 and is snap-fitted to the female buckle 2, the pressed portion 2021 is pushed by the male buckle 1 to cause the sliding block 202 to move from the first position to a second position (see FIG. 10). A first elastic element 205 is provided between the support structure 204 and the sliding block 202. The first elastic element 205 is configured to maintain the sliding block 202 at the first position. It should be understood that, when the male buckle 1 is pulled out from the female buckle 2 so as to be unlocked from the female buckle 2, the sliding block 202 can automatically return from the second position to the first position under the action of the first elastic element 205.

Referring to FIG. 10, FIG. 11, FIG. 13, and FIG. 15, the following example will be described by taking the trigger portion 32*a* of the control switch 32 as the elastic trigger button 320. The elastic trigger button 320 is located on a moving path of the actuating portion 2022, thus it can be triggered by the actuating portion 2022. As such, after the male buckle 1 is inserted in place, the actuating portion 2022 moves with the sliding block 202 to, for example, an arcuate contact surface of the elastic trigger button 320, so that the control switch 32 is in the turned-on state. As described in the previous embodiments, in this case, the processor of the control circuit 3 may control the wireless communication module 31 to transmit the wireless signal. After the male buckle 1 and the female buckle 2 are unlocked, the actuating portion 2022 is automatically reset with the sliding block 202 and no longer presses the elastic trigger button 320, so that the elastic trigger button 320 is automatically reset, and the control switch 32 automatically returns to the turned-off state. In this case, the processor of the control circuit 3 controls the wireless communication module 31 to not transmit the wireless signal.

Figure 12:
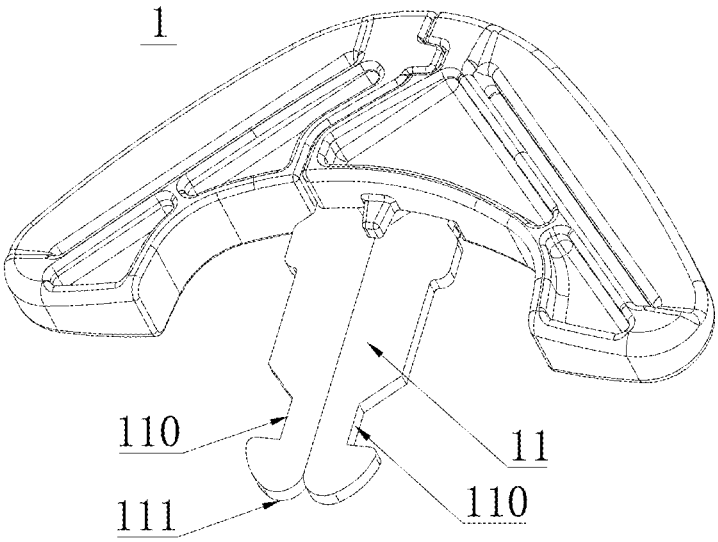
FIG. 12 is a perspective view of the male buckle in FIG. 9.

Referring to FIG. 12, a pushing step 12 may be provided in a middle portion of the male buckle 1. Referring to FIG.

10, the pushing step 12 can abut against the pressed portion 2021 to push the sliding block 202, so that the sliding block 202 can move from the first position to the second position.

Figure 13:
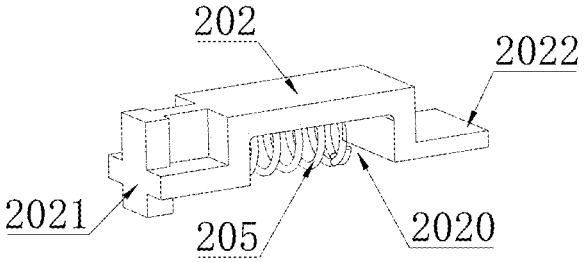
FIG. 13 is a perspective view of a sliding block and a first elastic element in the fastener.
Figure 14:
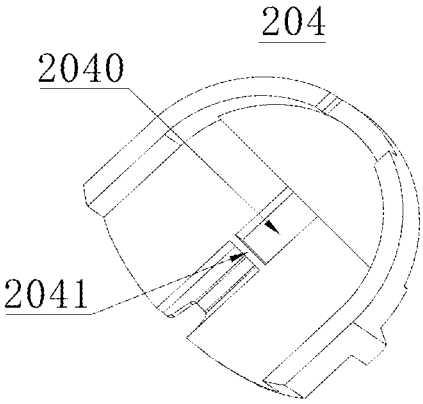
FIG. 14 is a perspective view of a support structure in the fastener.

Referring to FIG. 13, in some embodiments, in order to make the structure of the female buckle 2 more reasonable and compact, a first groove 2020 facing the support structure 204 may be provided at a middle portion of the sliding block 202. The support structure 204 has a limiting rib 2041 (FIG. 14) extending into the first groove 2020. The first elastic element 205 is located in the first groove 2020 and is sandwiched between a groove wall of the first groove 2020 and the limiting rib 2041. In addition, referring to FIG. 14, a second groove 2040 may be provided on the support structure 204. The actuating portion 2022 and the control switch 32 both extend into the second groove 2040. The elastic trigger button 320 of the control switch 32 can be completely located in the second groove 2040.

Figure 15:
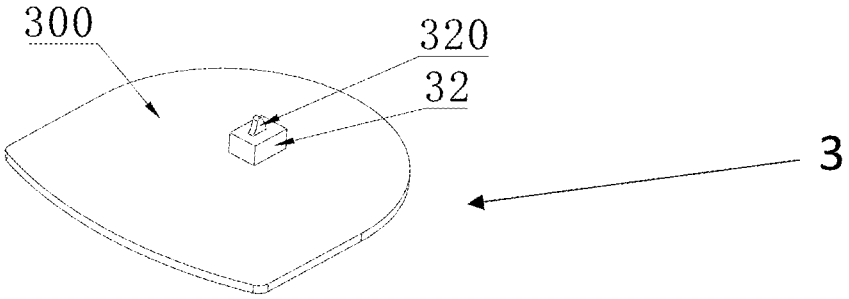
FIG. 15 is a perspective view of a circuit board.
Figure 16:
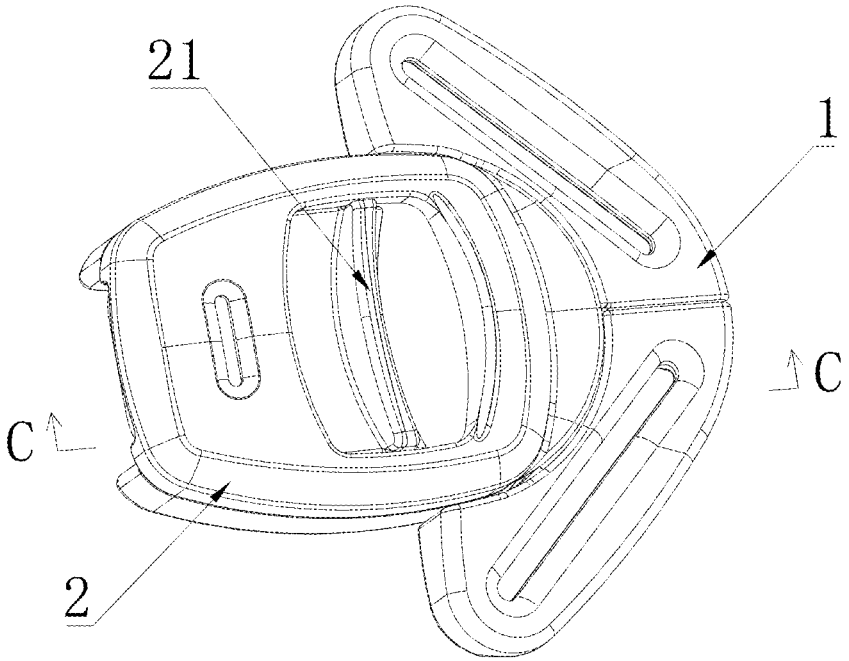
FIG. 16 is a perspective view of a fastener according to a third embodiment.
Figure 17:
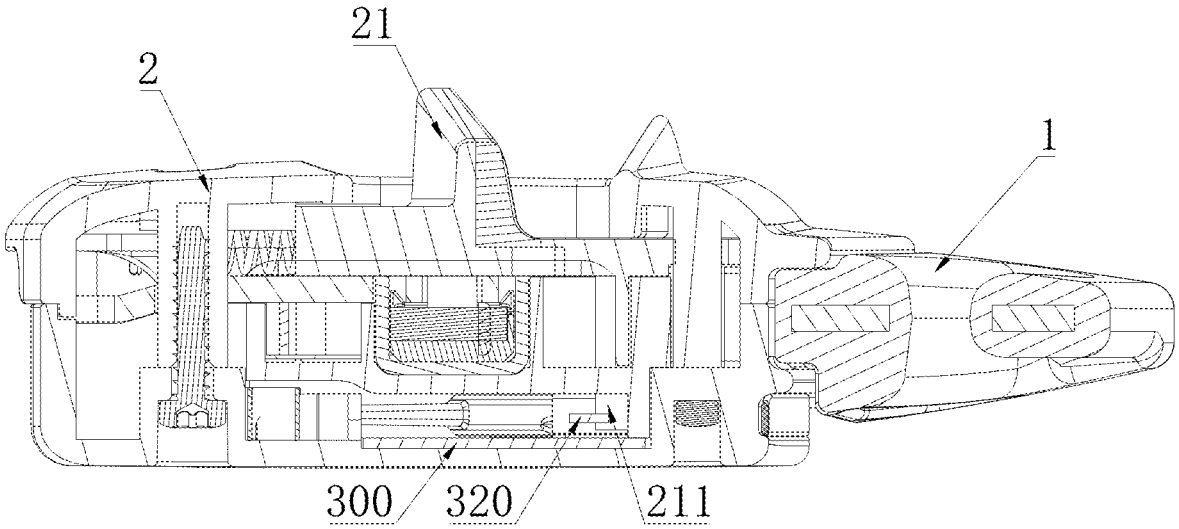
FIG. 17 is a cross-sectional view taken along C-C in FIG. 16.
Figure 18:
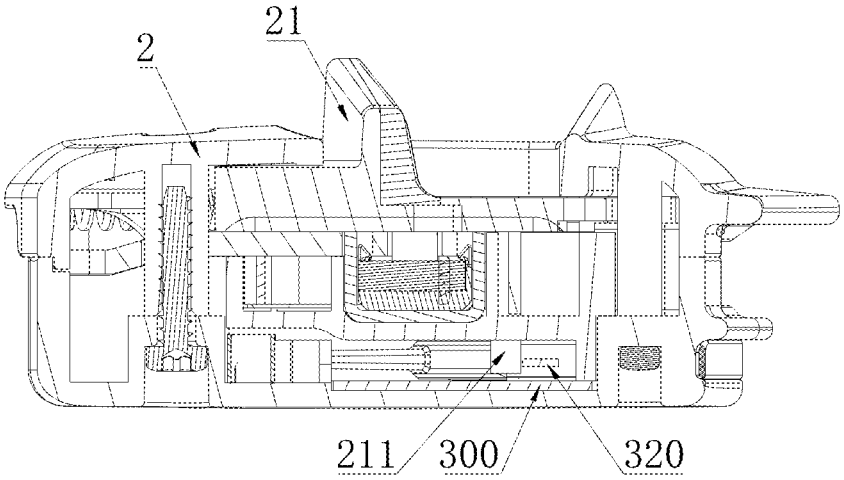
FIG. 18 is a cross-sectional view of FIG. 16 in another state, where an unlocking button is at an unlocked position, and a male buckle is completely pulled out of the female buckle.
Figure 19:
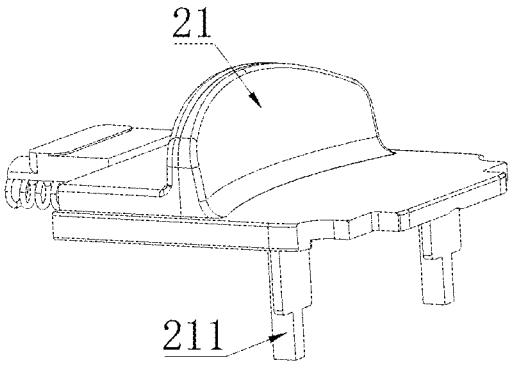
FIG. 19 is a perspective view of the unlocking button.

Referring to FIG. 15, in this embodiment, the control circuit 3 may be integrated on the circuit board 300, and the sliding block 202 may be sandwiched between the circuit board 300 and the support structure 204.

Third Embodiment

FIG. 16 to FIG. 20 schematically show a fastener according to a third embodiment of the present disclosure. The fastener in the third embodiment is similar to the fasteners according to the first embodiment and second embodiment. For example, the fastener includes a male buckle 1 and a female buckle 2. The male buckle 1 has an inserting portion (not shown), and the female buckle 2 has a slot (not shown). The inserting portion of the male buckle 1 may be inserted into the slot to be snap-fitted to the female buckle 2. The female buckle 2 has an unlocking button 21. The male buckle 1 and the female buckle 2 may be unlocked by pressing the unlocking button 21. Therefore, the fastener has the locked state and the unlocked state. The fastener includes a control circuit 3 (referring to FIG. 8). The control circuit 3 includes a control switch 32 and a wireless communication module 31. When the male buckle 1 and the female buckle 2 are switched between the locked state and the unlocked state, the control switch 32 may be switched between turn-on and turn-off. When the control switch 32 is turned on, a processor of the control circuit 3 controls the wireless communication module 31 to transmit a wireless signal. The wireless signal is, for example, transmitted through a wireless transmission a network and then received by a terminal device 5.

In addition, in this embodiment, the unlocking button 21 has a locked position and an unlocked position relative to the female buckle 2. When the male buckle 1 and the female buckle 2 are in the locked state, the unlocking button 21 is at the locked position. When the male buckle 1 and the female buckle 2 are in the unlocked state, the unlocking button 21 is at the unlocked position. Generally, when the male buckle 1 is inserted into the female buckle 2, the unlocking button 21 automatically moves from the unlocked position to the locked position. When the male buckle 1 is required to be pulled out, a pressing force is applied to the unlocking button 21 to cause the unlocking button 21 to move from the locked position to the unlocked position, so that the male buckle 1 is pulled out. A corresponding component (not shown) in the female buckle 2 acts to maintain the unlocking button 21 at the unlocked position. The female buckle 2 having the unlocking button 21 and the male buckle 1 mated with the female buckle 2 are described in the related art. Therefore, details are not described herein again.

Referring to FIG. 17 to FIG. 20, and FIG. 8, in this embodiment, the unlocking button 21 has a trigger rib 211 extending into the female buckle 2. The control switch 32 has a trigger portion 32*a* located in the female buckle 2. Movement of the trigger rib 211 can cause the trigger rib 211 to trigger the trigger portion 32*a* of the control switch 32 to turn on the control switch 32 or can cause the trigger rib 211 to be separated from the trigger portion 32*a* of the control switch 32 to turn off of the control switch 32. The processor of the control circuit 3 controls the wireless communication module 31 to transmit the wireless signal when the control switch 32 is turned on.

Figure 20:
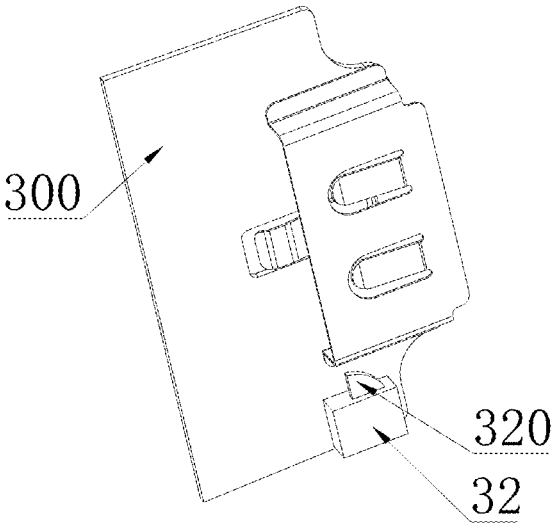
FIG. 20 is a perspective view of a circuit board.

Referring to FIG. 20, the control circuit 3 may be integrated on a circuit board 300. The circuit board 300 may be located in the female buckle 2. Similar to the previous embodiments, the control switch 32 may be a mechanical physical contact switch or an inductive switch. According to different types of the control switch 32, the trigger portion 32*a* of the control switch 32 may be an elastic trigger button 320 or a sensing module. When the control switch 32 is the mechanical physical contact switch, the trigger portion 32*a* may be the elastic trigger button 320. The elastic trigger button 320 may be located on a moving path of the trigger rib 211 and can be triggered by the trigger rib 211.

As such, after the male buckle 1 is inserted in place, the unlocking button 21 moves from the unlocked position to the locked position, the trigger rib 211 moves with the unlocking button 21 and can directly press the elastic trigger button 320. The elastic trigger button 320 is, for example, pivotally pressed to be triggered. In this case, the control switch 32 is in a turned-on state, and the processor of the control circuit 3 controls the wireless communication module 31 to transmit the wireless signal. When the unlocking button 21 moves from the locked position to the unlocked position to unlock the male buckle 1 from the female buckle 2, the trigger rib 211 moves with the unlocking button 21 to be separated and no longer presses the elastic trigger button 320, so that the elastic trigger button 320 is automatically reset, and the control switch 32 automatically returns to a turned-off state. In this case, the wireless communication module 31 does not transmit the wireless signal.

According to another embodiment, a fastener monitoring system is further provided. The fastener monitoring system may include the terminal device 5 and any of the aforementioned fasteners. The terminal device 5 is configured to receive the wireless signal transmitted by the wireless communication module 31. Therefore, a user can remotely monitor whether the fastener is in a locked state.

As described in the above first embodiment, the terminal device 5 may be a mobile terminal, such as a mobile phone, a smart watch, or a smart bracelet. In addition, when the fastener is in the locked state and the mobile terminal is away from the fastener by a distance not less than a preset distance (for example, 5 meters), the terminal device 5 sends out the warning signal. Alternatively, when a signal intensity of the wireless signal received by the terminal device 5 decreases until the signal intensity is not greater than a threshold, the terminal device 5 sends out the warning signal. The fastener is especially applicable to child safety seats. Therefore, the child can be prevented from being left in the vehicle.

According to an embodiment, a child carrier is provided. The child carrier may include any of the above fasteners. The child carrier having the fastener may help caregivers of the children to monitor the locking state of the fastener remotely, thereby ensuring the safety of the children. In addition, the children can be prevented from being bound in the child carrier and left in a hazardous environment as a result of being neglected by the caregivers.

The technical features in the foregoing embodiments may be randomly combined. For concise description, not all possible combinations of the technical features in the embodiments are described. However, as long as combinations of the technical features do not conflict with each other, the combinations of the technical features are considered as falling within the scope described in this specification.

The foregoing embodiments only describe several implementations of this application, and their description is relatively specific and detailed, but cannot be construed as a limitation to the patent scope of this application. For a person of ordinary skill in the art, several transformations and improvements can be made without departing from the idea of this application. These transformations and improvements belong to the protection scope of this application. Therefore, the protection scope of the patent of this application shall be subject to the appended claims.

What is claimed is:

1. A fastener, comprising:

a male buckle;

a female buckle configured to be snap-fitted to the male buckle; and a control circuit disposed on at least one of the male buckle or the female buckle, the control circuit comprising a wireless communication module, wherein the fastener has a locked state in which the male buckle is snap-fitted to the female buckle and an unlocked state in which the male buckle is separated from the female buckle, and when the fastener is in the locked state, the wireless communication module transmits a wireless signal, wherein the control circuit further comprises a control switch, responsive to the fastener being switched between the locked state and the unlocked state, the control switch is switched between turn-on and turn-off, and the wireless communication module transmits the wireless signal in response to the control switch being turned on, wherein the female buckle has a slot, the male buckle has an inserting portion, and the control switch has a trigger portion located in the female buckle, wherein the female buckle is provided with a driving member and a sliding locking block configured to lock the inserting portion, wherein the driving member comprises a return elastic piece located in the female buckle, the trigger portion is located on a moving path of the middle portion of the return elastic piece, a middle portion of the return elastic piece is pressed by an end portion of the inserting portion of the male buckle, an end of the return elastic piece abuts against an outer side of the sliding locking blocks, so as to cause the sliding locking block to maintain at a position where the male buckle is locked, and wherein in response to the inserting portion of the male buckle being inserted into the slot of the female buckle to cause the fastener to switch from the unlocked state to the locked state, the middle portion of the return elastic piece is pushed by the male buckle to trigger the trigger portion, so as to cause the control switch to be turned on.

2. The fastener according to claim 1, further comprising:

a circuit board, wherein the control circuit is integrated on the circuit board; and a power supply mounted to the circuit board and configured to supply power to the control circuit.

3. The fastener according to claim 1, wherein responsive to the inserting portion of the male buckle being pulled out of the slot of the female buckle to cause the fastener to switch from the locked state to the unlocked state, the driving member returns automatically and is separated from the trigger portion, so as to cause the control switch to be turned off.

4. The fastener according to claim 3, wherein the trigger portion is an elastic trigger button.

5. The fastener according to claim 1, wherein the female buckle is provided with a through hole at a position corresponding to an elastic trigger button of the trigger portion, a trigger member movable along the through hole is disposed in the through hole, and the return elastic piece triggers the elastic trigger button by using the trigger member.

6. The fastener according to claim 5, wherein a first end of the trigger member abuts against the elastic trigger button, and a second end of the trigger member is provided with a slope configured to abut against the return elastic piece.

7. The fastener according to claim 6, wherein the trigger member is a U-shaped plate, a closed end of the U-shaped plate forms the first end of the trigger member, and an open end of the U-shaped plate forms the second end of the trigger member, and an axial direction of the through hole is perpendicular to an insertion direction of the male buckle.

8. The fastener according to claim 5, wherein the female buckle is provided with two sliding locking blocks therein, the inserting portion of the male buckle passes through the two sliding locking blocks and is locked by the two sliding locking blocks, and two ends of the return elastic piece respectively abut against outer sides of the two sliding locking blocks facing away from each other, so as to cause the two sliding locking blocks to maintain at the position where the male buckle is locked.

9. A fastener, comprising:

a male buckle;

a female buckle configured to be snap-fitted to the male buckle; and a control circuit disposed on at least one of the male buckle or the female buckle, the control circuit comprising a wireless communication module, wherein the fastener has a locked state in which the male buckle is snap-fitted to the female buckle and an unlocked state in which the male buckle is separated from the female buckle, and when the fastener is in the locked state, the wireless communication module transmits a wireless signal, wherein the control circuit further comprises a control switch, responsive to the fastener being switched between the locked state and the unlocked state, the control switch is switched between turn-on and turn-off, and the wireless communication module transmits the wireless signal in response to the control switch being turned on, wherein the female buckle has a slot, the male buckle has an inserting portion, and the control switch has a trigger portion located in the female buckle, wherein a driving member is disposed in the female buckle, and in response to the inserting portion of the male buckle being inserted into the slot of the female buckle to cause the fastener to switch from the unlocked state to the locked state, the driving member is pushed by the male buckle to trigger the trigger portion, so as to cause the control switch to be turned on, and responsive to the inserting portion of the male buckle being pulled out of the slot of the female buckle to cause the fastener to switch from the locked state to the unlocked state, the driving member returns automatically and is separated from the trigger portion, so as to cause the control switch to be turned off, wherein the trigger portion is an elastic trigger button, wherein the driving member comprises a sliding block located in the female buckle, the sliding block is slidably mated with a support structure inside the female buckle, the sliding block has a pressed portion and an actuating portion, and responsive to the inserting portion of the male buckle being inserted in the slot of the female buckle, the pressed portion is pushed by the male buckle to cause the sliding block to move from a first position to a second position, wherein a first elastic element is provided between the support structure and the sliding block, the first elastic element is configured to maintain the sliding block at the first position responsive to the inserting portion of the male buckle being pulled out of the female buckle, and wherein the trigger portion is located on a moving path of the actuating portion and is capable of being triggered by the actuating portion.

10. The fastener according to claim 9, wherein a middle portion of the sliding block is provided with a first groove facing the support structure, the support structure has a limiting rib extending into the first groove, and the first elastic element is located in the first groove and is sandwiched between a groove wall of the first groove and the limiting rib.

11. The fastener according to claim 10, wherein the support structure is provided with a second groove, and the actuating portion and the control switch both extend into the second groove.

12. The fastener according to claim 9, wherein the male buckle is provided with a pushing step that is configured to abut against the pressed portion of the sliding block to push the sliding block.

13. The fastener according to claim 1, wherein the female buckle is provided with an unlocking button, the unlocking button is capable of moving between a locked position and an unlocked position, the unlocking button has a trigger rib extending into the female buckle, and the control switch has a trigger portion located in the female buckle, responsive to the unlocking button moving from the unlocked position to the locked position, the trigger rib triggers the trigger portion to cause the control switch to be turned on, and responsive to the unlocking button moving from the locked position to the unlocked position, the trigger rib is separated from the trigger portion to cause the control switch to be turned off.

14. The fastener according to claim 13, wherein the trigger portion comprises an elastic trigger button or a sensing module.

15. The fastener according to claim 1, wherein the wireless signal comprises position information or locking information of the fastener.

16. A child carrier, comprising the fastener according to claim 1 and a terminal device configured to receive the wireless signal transmitted by the wireless communication module.

17. The child carrier according to claim 16, wherein the terminal device is a mobile terminal, and responsive to a distance between the mobile terminal and the fastener being no less than a preset distance, or responsive to a signal intensity of the wireless signal received by the mobile terminal being no greater than a threshold, the mobile terminal sends out a warning signal.

18. The fastener according to claim 3, wherein the trigger portion is a sensing module.

* * * * *